US010704151B2

(12) United States Patent
Park

(10) Patent No.: US 10,704,151 B2
(45) Date of Patent: Jul. 7, 2020

(54) PICKLING APPARATUS AND PICKLING METHOD

(71) Applicant: POSCO, Pohang-si, Gyeongsangbuk-do (KR)

(72) Inventor: Hyoung-Kuk Park, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 35 days.

(21) Appl. No.: 16/062,560

(22) PCT Filed: Jul. 28, 2016

(86) PCT No.: PCT/KR2016/008279
§ 371 (c)(1),
(2) Date: Jun. 14, 2018

(87) PCT Pub. No.: WO2017/104926
PCT Pub. Date: Jun. 22, 2017

(65) Prior Publication Data

US 2018/0371626 A1 Dec. 27, 2018

(30) Foreign Application Priority Data

Dec. 18, 2015 (KR) ..... 10-2015-0181711

(51) Int. Cl.
*C23G 3/02* (2006.01)

(52) U.S. Cl.
CPC ..... *C23G 3/024* (2013.01); *C23G 3/025* (2013.01); *C23G 3/029* (2013.01)

(58) Field of Classification Search
CPC ..... C23G 3/024; C23G 3/025; C23G 3/029
USPC ..... 134/61
See application file for complete search history.

(56) References Cited

U.S. PATENT DOCUMENTS 4,920,995 A 5/1990 Seiz et al.
6,305,096 B1 10/2001 Hirai et al.
2010/0269854 A1* 10/2010 Barbieri ..... C23G 3/02 134/3

(Continued)

FOREIGN PATENT DOCUMENTS

CN 203284471 U 11/2013
CN 203728930 U 7/2014
CN 105050687 A 11/2015

(Continued)

OTHER PUBLICATIONS

DE4228808A1—machine translation (Year: 1994).*

(Continued)

*Primary Examiner* — Tinsae B Ayalew
(74) *Attorney, Agent, or Firm* — Morgan, Lewis & Bockius LLP

(57) ABSTRACT

A pickling apparatus includes a plurality of pickling tanks in which a scale of a steel plate is removed while the steel plate is advanced and sequentially dipped; an intermediate spraying unit, disposed between a pickling tank at the front end and a pickling tank at the rear end, for spraying a pickling solution onto the steel plate; and a pickling solution supply means configured to provide a pickling solution of a concentration used in the pickling tank at the rear end to the intermediate spraying unit, wherein a wringer roll disposed between the plurality of pickling tanks is removed.

5 Claims, 2 Drawing Sheets

(56) References Cited

U.S. PATENT DOCUMENTS

| | | | |
|---|---|---|---|
| 2014/0199221 | A1 | 7/2014 | Suchak |
| 2015/0055994 | A1 | 2/2015 | Shoji et al. |

FOREIGN PATENT DOCUMENTS

| | | | |
|---|---|---|---|
| DE | 4228808 | A1 | 3/1994 |
| JP | 59-212115 | A | 12/1984 |
| JP | S60-128274 | A | 9/1985 |
| JP | H03-500907 | A | 2/1991 |
| JP | H05-027052 | U | 4/1993 |
| JP | H05-125573 | A | 5/1993 |
| JP | H06-055213 | A | 3/1994 |
| JP | H09-003673 | A | 1/1997 |
| JP | H09-059790 | A | 3/1997 |
| JP | H10-273789 | A | 10/1998 |
| JP | H11-012772 | A | 1/1999 |
| JP | 2005-200697 | A | 7/2005 |
| JP | 2007-031791 | A | 2/2007 |
| JP | 2009-173980 | A | 8/2009 |
| KR | 10-2004-0055999 | A | 6/2004 |
| KR | 10-2015-0055994 | A | 5/2015 |
| WO | 99/46427 | A1 | 9/1999 |

OTHER PUBLICATIONS

Extended European Search Report dated Dec. 17, 2018 issued in European Patent Application No. 16875868.8.

Chinese Office Action dated Jul. 15, 2019 issued in Chinese Patent Application No. 201680073446.4.

Japanese Office Action dated Jul. 16, 2019 issued in Japanese Patent Application No. 2018-531247 (partial English translation).

International Search Report dated Nov. 1, 2016 issued in International Patent Application No. PCT/KR2016/008279 (with English translation).

* cited by examiner

【Figure 1】
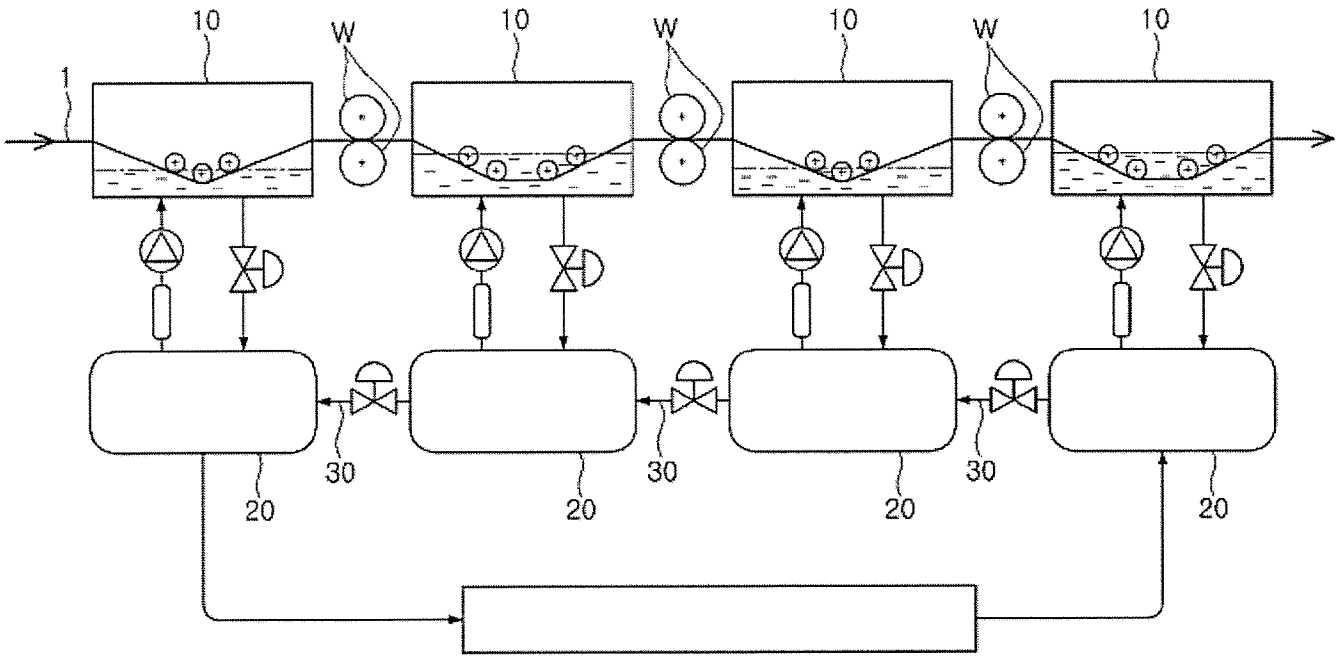

【Figure 2】
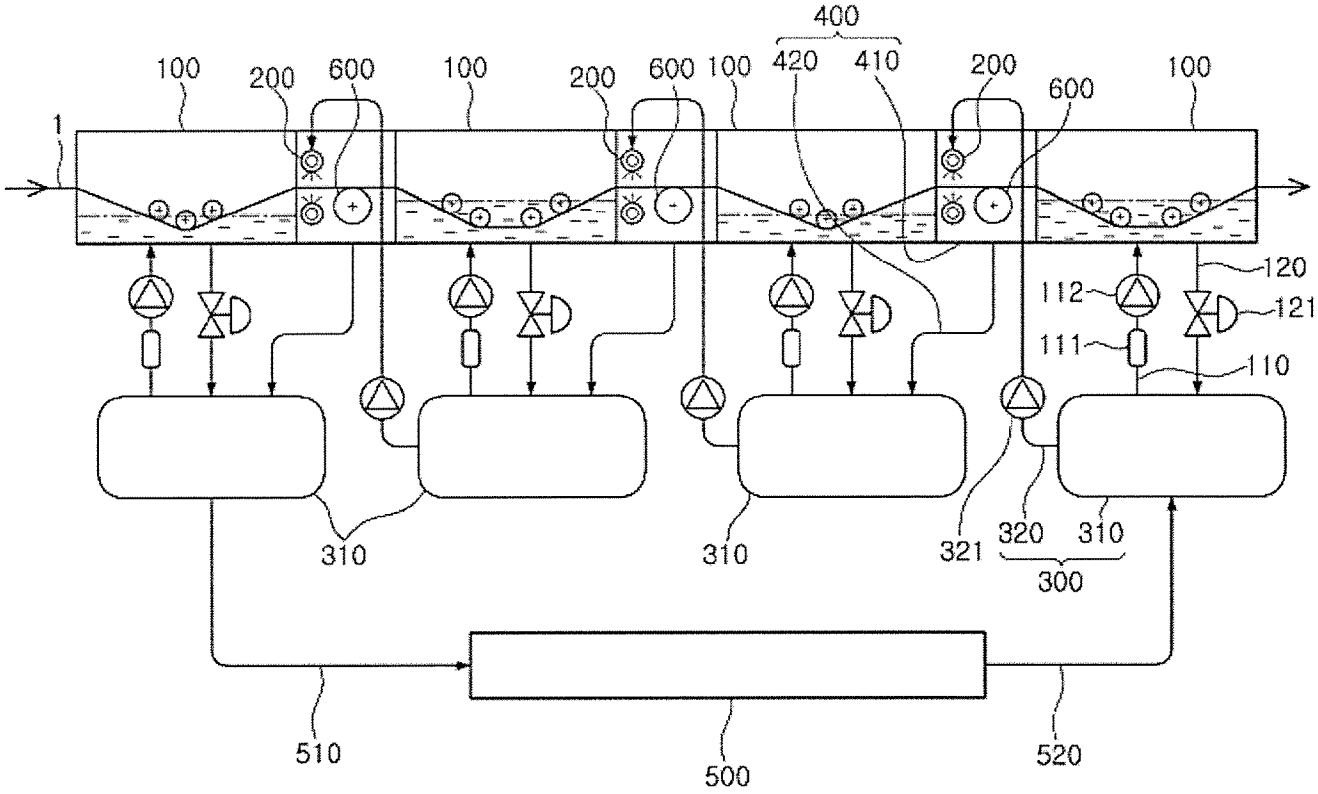

PICKLING APPARATUS AND PICKLING METHOD

CROSS REFERENCE

This patent application is the U.S. National Phase under 35 U.S.C. § 371 of International Application No. PCT/KR2016/008279, filed on Jul. 28, 2016, which claims the benefit of Korean Patent Application No. 10-2015-0181711, filed on Dec. 18, 2015, the entire contents of each are hereby incorporated by reference.

TECHNICAL FIELD

The present disclosure relates to a pickling apparatus and a pickling method, and more particularly, to a pickling apparatus and a pickling method for removing scale from a steel sheet.

BACKGROUND ART

In general, a hot-rolled steel sheet is moved and dipped in a plurality of pickling tanks accommodating a pickling solution to remove scale through a chemical reaction with the pickling solution.

As illustrated in FIG. 1, in a related art pickling apparatus for removing scale from a steel sheet, a plurality of pickling tanks 10 are sequentially arranged and a steel sheet 1 is advanced and sequentially dipped in a plurality of pickling tanks 10 to remove scale from the steel sheet.

Concentrations of the pickling solutions respectively accommodated in the plurality of pickling tanks 10 are different. The steel plate 1 is dipped in the forward pickling tank 10 and subsequently transferred to the rear pickling tank 10, and, in this process, since the pickling solution accommodated in the forward pickling tank 10 adheres to the steel plate 1 and the steel plate 1 with the pickling solution of the first pickling tank is introduced to the rear pickling tank 10, a concentration of the rear pickling tank 10 is affected.

Thus, a wringer roll W is disposed between the plurality of pickling tanks 10. The wringer roll W is provided in pairs to press the steel plate 1 upwards and downwards to squeeze out the pickling solution adhering to the steel plate 1 to remove the pickling solution to not be introduced to the rear pickling tank 10.

However, the wringer roll W is formed of a rubber material, and one-sided wear occurs due to a defective shape of the steel plate 1, or the like.

The wringer roll W in which one-sided wear occurs causes the advancing steel plate to zigzag (or skew or meander) to scratch the pickling tank 10 and lower a pickling speed.

Further, the life of the wringer roll W is usually about two months, and productivity thereof is deteriorated due to repair costs and a replacement time, according to maintenance.

DISCLOSURE

Technical Problem

An aspect of the present disclosure is to provide a pickling apparatus configured to eliminate a wringer roll between a plurality of pickling tanks, and a pickling method.

Technical Solution

According to an aspect of the present disclosure, a pickling apparatus includes: a plurality of pickling tanks in which scale of a steel plate is removed while the steel plate is advanced and sequentially dipped; an intermediate spraying unit disposed between a forward pickling tank and a rear pickling tank to spray a pickling solution to the steel plate; and a pickling solution providing unit providing a pickling solution having a concentration used in the rear pickling tank to the intermediate spraying unit, wherein a wringer roll disposed between the plurality of pickling tanks is eliminated.

Here, the pickling solution providing unit may include: a plurality of circulation tanks arranged to respectively correspond to the plurality of pickling tanks and maintaining a pickling solution level of the picking tank as the pickling solution is circulated, with the corresponding pickling tank; and a supply line supplying the pickling solution from a rear circulation tank corresponding to the rear pickling tank to the intermediate spraying unit.

Also, the pickling apparatus may further include: a pickling solution transfer unit transferring the pickling solution sprayed by the intermediate spraying unit to the front circulation tank corresponding to the forward pickling tank, wherein the pickling solution transfer unit may include: a connection chamber connecting the forward pickling tank and the rear pickling tank and including the intermediate spraying unit; and a transfer line connected to the front circulation tank corresponding to the forward pickling tank from the connection chamber and transferring the pickling solution sprayed by the intermediate spraying unit.

In addition, the pickling apparatus may further include: a pickling solution regeneration unit connected to a foremost circulation tank and a rearmost circulation tank, among the plurality of circulation tanks, regenerating the pickling solution discharged from the foremost circulation tank, and supplying the regenerated pickling solution to the rearmost circulation tank, to form a circulation structure of the pickling solution, wherein a flow rate of the pickling solution sprayed from the intermediate spraying unit may be equal to or greater than a flow rate of the pickling solution supplied to the rearmost circulation tank from the pickling solution regeneration unit.

Also, a support roll upwardly supporting the steel plate may be disposed between the plurality of the pickling tanks.

In addition, a concentration of the pickling solution accommodated in the plurality of pickling tanks may be increased toward the rear pickling tank.

According to another aspect of the present disclosure, a pickling method includes: a scale removing operation in which a scale of a steel plate is removed while the steel plate is advanced and sequentially dipped in a plurality of pickling tanks; an intermediate spraying operation in which the pickling solution is sprayed to the steel plate by an intermediate spraying unit between a forward pickling tank and a rear pickling tank during the scale removing operation; and a pickling solution providing operation in which the pickling solution having a concentration used in the rear pickling tank is provided to the intermediate spraying unit, before the intermediate spraying operation, wherein a wringer roll disposed between the plurality of pickling tanks is eliminated.

Here, in the pickling solution providing operation, a plurality of the circulation tanks may be arranged to respectively correspond to the plurality of pickling tanks, and the pickling solution may be supplied to the intermediate spraying unit from a rear circulation tank corresponding to the rear pickling tank, among the plurality of circulation tanks maintaining the pickling solution level of the pickling tank, as the pickling solution is circulated, with the corresponding pickling tank.

Here, the pickling method may further include: a pickling solution transfer operation in which a connection chamber connecting the forward pickling tank and the rear pickling tank and including the intermediate spraying unit transfers the pickling solution sprayed by the intermediate spraying unit to the front circulation tank corresponding to the forward pickling tank.

Also, the pickling method may further include: a pickling solution circulating operation in which the pickling solution discharged from the foremost circulation tank is regenerated by a pickling solution regeneration unit connected to the foremost circulation tank and the rearmost circulation tank, among the plurality of the circulation tanks, and introduced to the rearmost circulation tank, wherein a flow rate of the pickling solution sprayed by the intermediate spraying unit is equal to or greater than a flow rate of the pickling solution introduced to the rearmost circulation tank from the pickling solution regeneration unit.

Advantageous Effects

As set forth above, according to an exemplary embodiment in the present disclosure, the pickling apparatus and the pickling method according to the present disclosure are configured to spray a pickling solution having a concentration used in a rear pickling tank to a steel sheet between a forward pickling tank and the rear pickling tank by an intermediate spraying unit and a pickling solution supply unit, thus eliminating a wringer roll disposed between the plurality of pickling tanks, and since the pickling solution adhering to the steel plate in the forward pickling tank is washed out without using the wringer roll, the concentration of the pickling solution at the rear pickling tank is not affected and the problem and limitation of the wringer roll which is one-sidedly worn due to a defective shape of the steel plate to cause the steel plate to go zigzag (or skew) to scratch the pickling tank and lower a pickling speed and which deteriorates productivity due to repair cost and a replacement time according to maintenance may be overcome.

DESCRIPTION OF DRAWINGS

FIG. 1 is a schematic view illustrating a pickling apparatus according to the related art.

FIG. 2 is a schematic view illustrating a pickling apparatus according to an embodiment of the present disclosure.

BEST MODE FOR INVENTION

Hereinafter, exemplary embodiments of the present disclosure will be described in detail with reference to the accompanying drawings. In adding reference numerals for elements in each drawing, it should be noted that like reference numerals already used to denote like elements in other drawings are used for elements wherever possible. In the following description, when the detailed description of the relevant known function or configuration is determined to unnecessarily obscure the important point of the present disclosure, the detailed description will be omitted.

FIG. 2 is a schematic view illustrating a pickling apparatus according to an embodiment of the present disclosure.

Referring to FIG. 2, a pickling apparatus according to the present disclosure includes a plurality of pickling tanks 100, an intermediate spraying unit 200 spraying a pickling solution to a steel sheet 1, and a pickling solution providing unit 300 providing the pickling solution to the intermediate spraying unit 200.

Here, a main structural feature of the present disclosure is that, a wringer roll disposed between the plurality of pickling tanks 100 is eliminated, and, instead of the wringer roll, the intermediate spraying unit 200 and the pickling solution providing unit 300 are configured such that a concentration of the pickling solution of the rear pickling tank 100 is not affected by a pickling solution adhering to the steel plate 1 from the forward pickling tank 100.

That is, in the present disclosure, since the intermediate spraying unit 200 and the pickling solution providing unit 300 are provided to eliminate the wringer roll to be disposed between the plurality of pickling tanks 100, problems and limitations due to the wringer roll may be overcome. For reference, the wringer roll formed of a rubber material has a problem that it is one-sidedly worn due to a defective shape of the steel plate 1 to cause the steel plate 1 to go zigzag due to one-sided wear to scratch the pickling tank 100 and lower a pickling speed, and in addition, has a limitation in that it deteriorates productivity due to repair cost and replacement time according to maintenance.

In order to realize the object of the present disclosure described above, the present disclosure includes, as a specific structural feature, the intermediate spraying unit 200 and the pickling solution providing unit 300 configured such that the pickling solution having the concentration used in the rear pickling tank 100 is sprayed to the steel plate 1 between the forward pickling tank 100 and the rear pickling tank 100.

That is, a structural feature of the present disclosure is that the intermediate spraying unit 200 is configured to spray the pickling solution to the steel plate 1 and is disposed between the forward pickling tank 100 and the rear pickling tank 100 in terms of arrangement structure and the pickling solution providing unit 300 is configured to provide the pickling solution having the concentration used in the rear pickling tank 100 to the intermediate spraying unit 200.

Accordingly, the wringer rolls disposed between the plurality of pickling tanks 100 may be eliminated to overcome the above-mentioned problems and limitations, and instead of the eliminated wringer rolls, the pickling solution adhering to the steel plate 1 in the forward pickling tank 100 may be removed before the steel plate 1 is moved to the rear pickling tank 100. In other words, the intermediate spraying unit 200 receives the pickling solution having the concentration used in the rear pickling tank 100 by the pickling solution providing unit 300 and spray the same to the steel plate 1 between the forward pickling tank 100 and the rear pickling tank 100 to thereby wash out and remove the pickling solution adhering to the steel plate 1 in the forward pickling tank 100.

For reference, the pickling solution sprayed by the intermediate spraying unit 200 may adhere to the steel plate 1 and may be led to the rear pickling tank 100, and here, since the pickling solution sprayed by the intermediate spraying unit 200 has the same concentration as that of the pickling solution used in the rear pickling tank 100, and thus, the pickling solution sprayed by the intermediate spraying unit 200 does not affect the concentration of the pickling solution of the rear pickling tank 100.

Meanwhile, more specifically, the pickling solution providing unit 300 may include a circulation tank 310 connected to the pickling tank 100 and a supply line 320 connecting the circulation tank 310 and the intermediate spraying unit 200.

Here, a plurality of the circulation tanks 310 are arranged to correspond to the plurality of pickling tanks 100 to maintain a pickling solution level of the pickling tanks 100 as the pickling solution is circulated with the corresponding pickling tanks 100.

To this end, the circulation tank 310 is connected to each of an inlet line 110 and an outlet line 120 of the pickling tank 100. The inlet line 110 is provided with a heat exchanger 111, and the outlet line 120 is provided with a flow rate control valve 121.

The pickling solution, which is lowered in temperature as the pickling solution is used and heat-exchanged with the steel plate 1, flows out to the circulation tank 310 through the outlet line 120 of the pickling tank 100, and when the pickling solution flows back to the pickling tank 100 through the inlet line 110 from the circulation tank 310 by an inlet pump 112, the pickling solution is heated to an appropriate temperature by a heat exchanger 111 and introduced to the pickling tank 100. Here, the flow rate control valve 121 continuously maintains an appropriate level of the pickling solution in the pickling tank 100.

The supply line 320 connects the intermediate spraying unit 200 disposed between the forward pickling tank 100 and the rear pickling tank 100 and a rear circulation tank 310 corresponding to the rear pickling tank 100.

The supply line 320 serves to supply the pickling solution from the rear circulation tank 310 corresponding to the rear pickling tank 100 to the intermediate spraying unit 200 disposed between the forward pickling tank 100 and the rear pickling tank 100 by means of a supply pump 321.

In addition, the present disclosure may further include a pickle solution transfer unit 400 transferring the pickling solution sprayed by the intermediate spraying unit 200 to the front circulation tank (310) corresponding to the forward pickling tank 100.

Compared to the related art pickling apparatus 1 as illustrated in FIG. 1 in which the connection line 30 is configured between the plurality of circulation tanks 20 corresponding to the plurality of pickling tanks 10 to connect the rear circulation tank 20 and the front circulation tank 20 to transfer the pickling solution, in the present disclosure, as illustrated in FIG. 2, the pickling solution transfer unit 400 transfers the pickling solution sprayed by the intermediate spraying unit 200 to the front circulation tank 310 corresponding to the forward pickling tank 100.

More specifically, the pickling solution transfer unit 400 may include a connection chamber 410 connecting the forward pickling tank 100 and the rear pickling tank 100 and including the intermediate spraying unit 200 and a transfer line 420 connected from the connection chamber 410 to the front circulation tank 310 corresponding to the forward pickling tank 100 to transfer the pickling solution sprayed by the intermediate spraying unit 200.

Accordingly, the pickling solution sprayed by the intermediate spraying unit 200 may be collected in the connection chamber 410 and transferred to the front circulation tank 310 through the transfer line 420.

For reference, the pickling solution used in the forward pickling tank 100 is lower in concentration than the pickling solution used in the rear pickling tank 100. Here, as the concentration of the pickling solution sprayed by the intermediate spraying unit 200 is lowered through a chemical action during a process of removing scale from the steel plate 1, the pickling solution transferred to the front circulation tank 310 may be substantially equal to the concentration of the front circulation tank 310.

Further, the present disclosure further includes a pickling solution regeneration unit 500 to form a circulation structure of the pickling solution. The pickling solution regeneration unit 500 is connected to a foremost circulation tank 310 and a rearmost circulation tank 310, among the plurality of circulation tanks 310, to regenerate the pickling solution discharged from the foremost circulation tank 310 through an outlet line 510 and supply the regenerated pickling solution to the rearmost circulation tank 310 through an inlet line 520.

Here, in the present disclosure, preferably, a flow rate of the pickling solution sprayed by the intermediate spraying unit 200 is equal to or greater than a flow rate of the pickling solution flowing to the rearmost circulation tank 310 from the pickling solution regeneration unit 500.

If a flow rate of the pickling solution supplied by the pickling solution regeneration unit 500 to the rearmost circulation tank 310 is smaller than a flow rate of the pickling solution sprayed by the intermediate spraying unit 200 to transfer the pickling solution from the front circulation tank 310 to the rear circulation tank 310, the pickling solution overflows from the rear circulation tank 310, and if it is greater, the pickling solution overflows from the front circulation tank 310.

Accordingly, the flow rate of the pickling solution sprayed by the intermediate spraying unit 200 is preferably equal to the flow rate of the pickling solution supplied from the pickling solution regeneration unit 500 to the rearmost circulation tank 310.

Further, in addition to the above-described contents, if it is considered that the pickling solution sprayed by the intermediate spraying unit 200 adheres to the steel plate 1 and is transferred to the rear pickling tank 100, more preferably, the flow rate of the pickling solution sprayed by the intermediate spraying unit 200 is greater than the flow rate of the pickling solution supplied from the pickling solution regeneration unit 500 to the rearmost circulation tank 310 by the flow rate of the pickling solution adhering to the steel plate 1 and transferred.

Meanwhile, in the present disclosure, since the wringer roll is eliminated between the plurality of pickling tanks 100, a support roll 600 may be disposed to support the steel plate 1 between the plurality of pickling tanks 100.

That is, the support roll 600 may have a structure to upwardly support the steel plate 1 between the plurality of pickling tanks 100.

The plurality of pickling tanks 100 of the present disclosure are arranged such that the steel plate 1 is advanced and sequentially dipped so that scale of the steel plate 1 is removed, and here, the concentration of the pickling solution accommodated therein may be increased toward the rear side. Accordingly, scale removal efficiency may be increased while the steel plate 1 is sequentially dipped in the plurality of pickling tanks 100 arranged such that the concentration of the pickling solution is increased.

Meanwhile, the pickling method by the pickling apparatus of the present disclosure described above is summarized as follows.

First, in the pickling method of the present disclosure, a scale removing operation in which a scale of the steel plate 1 is removed as the steel plate 1 is advanced and sequentially dipped in the plurality of pickling tanks 100 is performed.

Also, an intermediate spraying operation in which the pickling solution is sprayed to the steel plate 1 by the intermediate spraying unit 200 between the forward pickling tank 100 and the rear pickling tank 100 is performed during the scale removing operation.

In addition, a pickling solution providing operation in which the pickling solution having a concentration used in the rear pickling tank 100 is provided to the intermediate spraying unit 200 is performed before the intermediate spraying step.

As described above, the wringer rolls disposed between the plurality of pickling tanks 100 may be eliminated through the pickling method of the present disclosure.

Specifically, in the pickling solution providing operation, a plurality of the circulation tanks 310 are arranged to respectively correspond to the plurality of pickling tanks 100, and the pickling solution is supplied to the intermediate spraying unit 200 from the rear circulation tank 310 corresponding to the rear pickling tank 100, among the circulation tanks 310 maintaining the pickling solution level of the pickling tank 100, as the pickling solution is circulated, with the corresponding pickling tank 100.

In addition, the present disclosure may further include a pickling solution transfer operation to transfer the pickling solution from the rear circulation tank 310 to the front circulation tank 310.

Here, in the pickling solution transfer operation, the connection chamber 410 connecting the forward pickling tank 100 and the rear pickling tank 100 and including the intermediate spraying unit 200 transfers the pickling solution sprayed by the intermediate spraying unit 20 to the front circulation tank 310 corresponding to the forward pickling tank 100.

Furthermore, the present disclosure may further include a pickling solution circulating operation by the pickling solution regeneration unit 500, and here, a flow rate of the pickling solution sprayed by the intermediate spraying unit 200 may be controlled to be equal to or greater than a flow rate of the pickling solution introduced to the rearmost circulation tank 310 from the pickling solution regeneration unit 500.

For reference, in the pickling solution regenerating step, the pickling solution discharged from the foremost circulation tank 310 is regenerated by the pickling solution regeneration unit 500 connected to the foremost circulation tank 310 and the rearmost circulation tank 310, among the plurality of the circulation tanks 310, and introduced to the rearmost circulation tank 310.

As a result, as described above, in the pickling apparatus and the pickling method according to the present disclosure, the pickling solution having a concentration used in a rear pickling tank is sprayed to the steel sheet 1 between the forward pickling tank 100 and the rear pickling tank 100 by the intermediate spraying unit 200 and the pickling solution providing unit 300, thus eliminating a wringer roll disposed between the plurality of pickling tanks 100, and since the pickling solution adhering to the steel plate 1 in the forward pickling tank 100 is washed out without using the wringer roll, the concentration of the pickling solution at the rear pickling tank 100 is not affected and the problem and limitation of the wringer roll which is one-sidedly worn due to a defective shape of the steel plate 1 to cause the steel plate 1 to go zigzag (or skew) to scratch the pickling tank 100 and lower a pickling speed and which deteriorates productivity due to repair cost and a replacement time according to maintenance may be overcome.

While the present disclosure has been described with reference to limited embodiments and drawings, it is to be understood that the present disclosure is not limited thereto and various changes and modifications may be made by those skilled in the art, without departing from the scope of the appended claims.

The invention claimed is:

1. A pickling apparatus comprising;

a plurality of pickling tanks in which scale of a steel plate is removed while the steel plate is advanced and sequentially dipped;

an intermediate spraying unit disposed between a forward pickling tank and a rear pickling tank to spray a pickling solution to the steel plate; and a pickling solution providing unit providing a pickling solution having a concentration used in the rear pickling, tank to the intermediate spraying unit, the pickling solution providing unit includes:

a plurality of circulation tanks arranged to respectively correspond to the plurality of pickling tanks and maintaining a pickling solution level of the picking tank as the pickling solution is circulated, with the corresponding pickling tank; and a supply line supplying the pickling solution from a rear circulation tank corresponding to the rear pickling tank to the intermediate spraying unit, wherein a concentration of the pickling solution accommodated in the plurality of pickling tanks is increased toward the rear pickling tank, wherein the pickling apparatus further comprises a pickling solution transfer unit transferring the pickling solution sprayed by the intermediate spraying unit to the front circulation tank corresponding to the forward pickling tank, wherein the pickling solution transfer unit includes;

a connection chamber connecting the forward pickling tank and the rear pickling tank and including the intermediate spraying unit; and a transfer line connected to the front circulation tank corresponding to the forward pickling tank from the connection chamber and transferring the pickling solution sprayed by the intermediate spraying unit, and wherein a wringer roll disposed between the plurality of pickling tanks is eliminated.

2. The pickling apparatus of claim 1, further comprising:

a pickling solution regeneration unit connected to a foremost circulation tank and a rearmost circulation tank, among the plurality of circulation tanks, regenerating the pickling solution discharged from the foremost circulation tank, and supplying the regenerated pickling solution to therearmost circulation tank, to form a circulation structure of the pickling solution, wherein a flow rate of the pickling solution sprayed from the intermediate spraying unit is equal to or greater than a flowrate of the pickling solution supplied to the rearmost circulation tank from the pickling solution regeneration unit.

3. The pickling apparatus of claim 1, wherein a support roll upwardly supporting the steel plate is disposed between the plurality of pickling tanks.

4. A pickling method comprising:

a scale removing operation in which a scale of a steel plate is removed while the steel plate is advanced and sequentially dipped in a plurality of pickling tanks;

an intermediate spraying operation in which the pickling solution is sprayed to the steel plate by an intermediate spraying unit between a forward pickling tank and a rear pickling tank during the scale removing operation; and a pickling solution providing operation in which the pickling, solution having a concentration used in the rear pickling tank is provided to the intermediate spraying unit, before the intermediate spraying operation, wherein in the pickling solution providing operation, a plurality of the circulation tanks are arranged to respectively correspond to the plurality of pickling tanks and the pickling solution is supplied to the intermediate spraying, unit from a rear circulation tank corresponding to the rear pickling tank, among the plurality of circulation tanks maintaining the pickling solution level of the pickling tank, as the pickling solution is circulated, with the corresponding pickling tank, wherein a concentration of the pickling solution accommodated in the plurality of pickling tanks is increased toward the rear pickling tank, wherein the pickling method further comprises a pickling solution transfer operation in which a connection chamber connecting the forward pickling tank and the rear pickling tank and including the intermediate spraying unit transfers the pickling solution sprayed by the intermediate spraying unit to the front circulation tank corresponding to the forward pickling tank, and wherein a wringer roll disposed between the plurality of pickling tanks is eliminated.

5. The pickling method of claim 4, further comprising:

a pickling solution circulating operation in which the pickling solution discharged from the foremost circulation tank is regenerated by a pickling solution regeneration unit connected to the foremost circulation tank and therearmost circulation tank, among the plurality of the circulation tanks, and introduced to the rearmost circulation tank, wherein a flow rate of the pickling solution sprayed by the intermediate spraying unit is equal to or greater than a flow rate of the pickling solution introduced to therearmost circulation tank from the pickling solution regeneration unit.

* * * * *